US012029262B2

(12) United States Patent
Kijowski

(10) Patent No.: US 12,029,262 B2
(45) Date of Patent: Jul. 9, 2024

(54) PROTECTIVE GARMENT

(71) Applicant: Jessica Kijowski, Jacksonville, FL (US)

(72) Inventor: Jessica Kijowski, Jacksonville, FL (US)

( * ) Notice: Subject to any disclaimer, the term of this patent is extended or adjusted under 35 U.S.C. 154(b) by 0 days.

(21) Appl. No.: 18/531,365

(22) Filed: Dec. 6, 2023

(65) Prior Publication Data

US 2024/0180271 A1 Jun. 6, 2024

Related U.S. Application Data

(60) Provisional application No. 63/429,570, filed on Dec. 2, 2022.

(51) Int. Cl.
*A41D 13/00* (2006.01)
*A41D 13/05* (2006.01)

(52) U.S. Cl.
CPC ..... *A41D 13/001* (2013.01); *A41D 13/0543* (2013.01)

(58) Field of Classification Search
CPC ..... A41D 17/00; A41D 17/005; A41D 17/02; A41D 13/001; A41D 13/0543; A41D 1/06
See application file for complete search history.

(56) References Cited

U.S. PATENT DOCUMENTS 3,783,451 A * 1/1974 Malin ..... A41D 13/001 2/DIG. 1
5,119,510 A * 6/1992 Schilling ..... A42B 1/045 2/202
5,249,307 A * 10/1993 Lemoine ..... A41D 13/02 2/84
5,553,399 A 9/1996 Strong
5,600,850 A * 2/1997 Shannon ..... A41D 13/001 2/69
5,611,082 A * 3/1997 Bull ..... A41D 13/00 2/79
7,243,375 B2 * 7/2007 Seo ..... A41D 13/001 2/69
10,993,485 B2 5/2021 Kü
11,419,369 B1 * 8/2022 Duke ..... A41D 31/245
2006/0048291 A1 * 3/2006 Sims ..... A41D 13/02 2/456
2015/0164175 A1 6/2015 Katsuya
2016/0021944 A1 1/2016 Miller
2016/0324264 A1 * 11/2016 Johnson ..... A43B 3/244
2019/0021409 A1 * 1/2019 West ..... A41D 13/001
2020/0345085 A1 * 11/2020 Iriarte Tineo ..... A41D 27/24

* cited by examiner

*Primary Examiner* — Katherine M Moran
(74) *Attorney, Agent, or Firm* — Lippes Mathias LLP; Mitchell Ghaneie; Josephine Chen

(57) ABSTRACT

An exemplary, nonlimiting embodiment of the present disclosure provides a lightweight, breathable protective garment configured to encompass the entirety of two limbs and their corresponding extremities, such as a pair of legs and feet, of an individual as a means of preventing an insect biting the skin of the limbs and corresponding extremities. The exemplary, nonlimiting embodiment of the present disclosure comprises a pair of pants and a pair of footwear. The pair of pants is constructed of a fabric which preferably comprises a single layer mesh impenetrable to a variety of insects. The footwear is secured to the pair of pants near the bottom of each pant leg.

20 Claims, 9 Drawing Sheets

PROTECTIVE GARMENT

CROSS-REFERENCE TO RELATED APPLICATION

This application claims the benefit of U.S. Provisional Application No. 63/429,570, filed Dec. 2, 2022, and is hereby incorporated by reference in its entirety for all purposes.

FIELD OF THE INVENTION

The subject matter disclosed herein relates to a protective garment which provides a protective barrier that fully encapsulates the entirety of each leg and feet of the wearer to prevent the wearer from insect bites, such as, but not limited to mosquitos, gnats or no-see-ums.

BACKGROUND

Venturing outdoors is often dependent, in part, on having adequate protection against biting insects. In many parts of the world flying insects are carriers of zoonotic diseases and exposure to flying insects, without proper protection, can at a minimum be a nuisance and at times be a serious life-threatening health hazard. Many forms of deterrents and protective barriers have been developed to aid in the prevention of such insect bites, such as chemical repellants and mosquito nets, respectively. While it is understood that a variety of chemical repellants exist, such as insecticides, each formulation is only effective for a limited duration and requires the user be vigilant of the amount of time which has lapsed since the most recent application of the chemical repellant. As it relates to mosquito nets, while such textiles are exceptionally effective in providing a protective boundary around an enclosed space, their functional modality is limited and not well suited for use as clothing. Furthermore, while teachings of manufacturing some garments with similar materials used in the manufacturing of mosquito nets is present in the prior art, such garments are limited in the areas in which they encapsulate and require that the garments be utilized with other non-integrated, discrete articles of clothing to provide supplemental protection. Accordingly, what is needed is a protective garment which allows for the complete encapsulation of a limb and its corresponding extremity, such as a leg and foot.

SUMMARY OF THE INVENTION protective garment which is configured to encompasses the limbs and corresponding extremities, such as the legs and feet, of the wearer as a means of preventing insect biting the limbs and corresponding extremities. The exemplary, nonlimiting embodiment of the protective garment is preferably constructed of materials that are water resistant and lightweight.

The exemplary, nonlimiting embodiment of the protective garment includes a pair of pants, which is constructed of a perforated fabric that further comprises a plurality of tightly woven fibers, and a pair of footwear. The pair of pants include a waistband and two pant legs. The waistband is preferably comprised of an elastic material but may alternatively comprise an enclosed strap or belt that provides a cinching mechanism to allow the diameter of the opening at the top of the pair of pants to expand or contract. The cinching mechanism may also further include as buckles, hook-and-loop, snaps, or buttons to uphold the diameter of the opening at the top of the pants.

The pair of footwear is preferably suitable for walking on exterior surfaces and is secured to the bottom end of each pant leg. It is anticipated that the pair of footwear may comprise a pair of sandals, slippers, or closed toe shoes. The pair of footwear is constructed of a plurality of elements which include a strap, an insole, and an outsole.

It is anticipated that the pair of footwear may optionally include toe or foot guards for footwear which are not comprised of closed toe shoes. Such toe or foot guards not only function to protect the wearer's feet, but also are configured to protect the perforated fabric near the bottom of the pant legs.

Other principal features and advantages of the invention will become apparent to those skilled in the art upon review of the following drawings, the detailed description and the appended claims.

NUMBER REFERENCES

Figure 1:
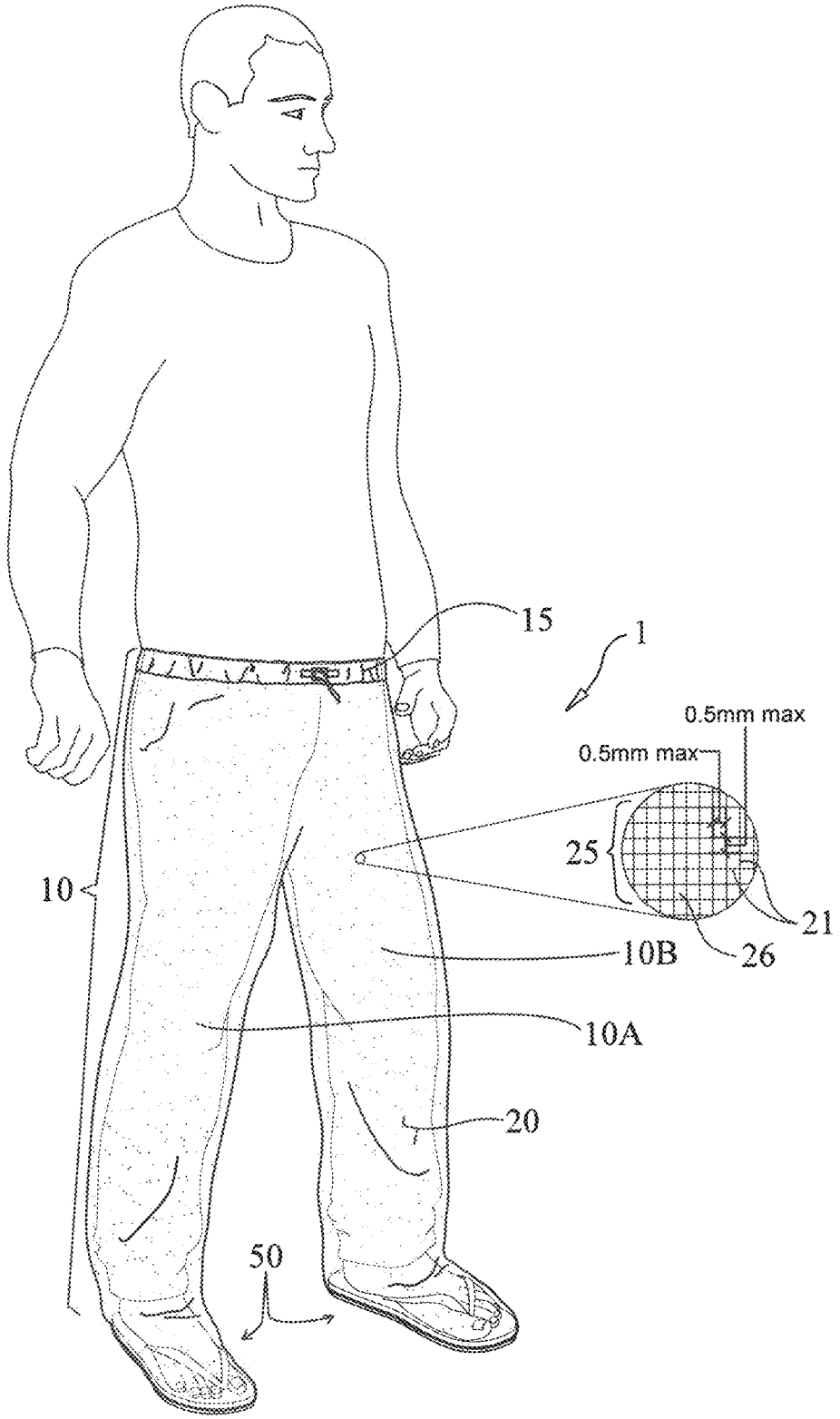
FIG. 1 is an in-use perspective view of an exemplary embodiment of a protective garment.
Figure 2:
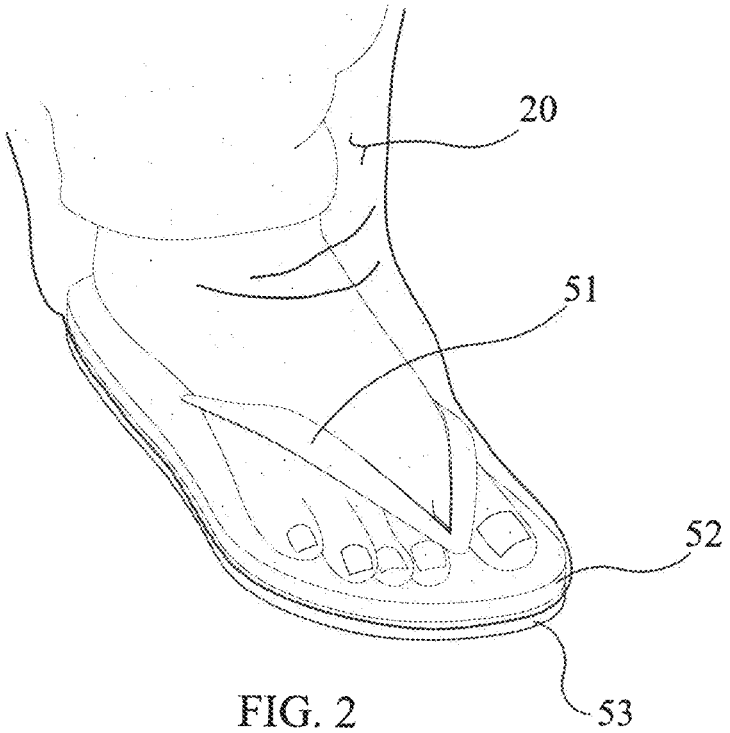
FIG. 2 is an enlarged view taken from FIG. 1 depicting a bottom portion of one of the two pant legs.
Figure 3:
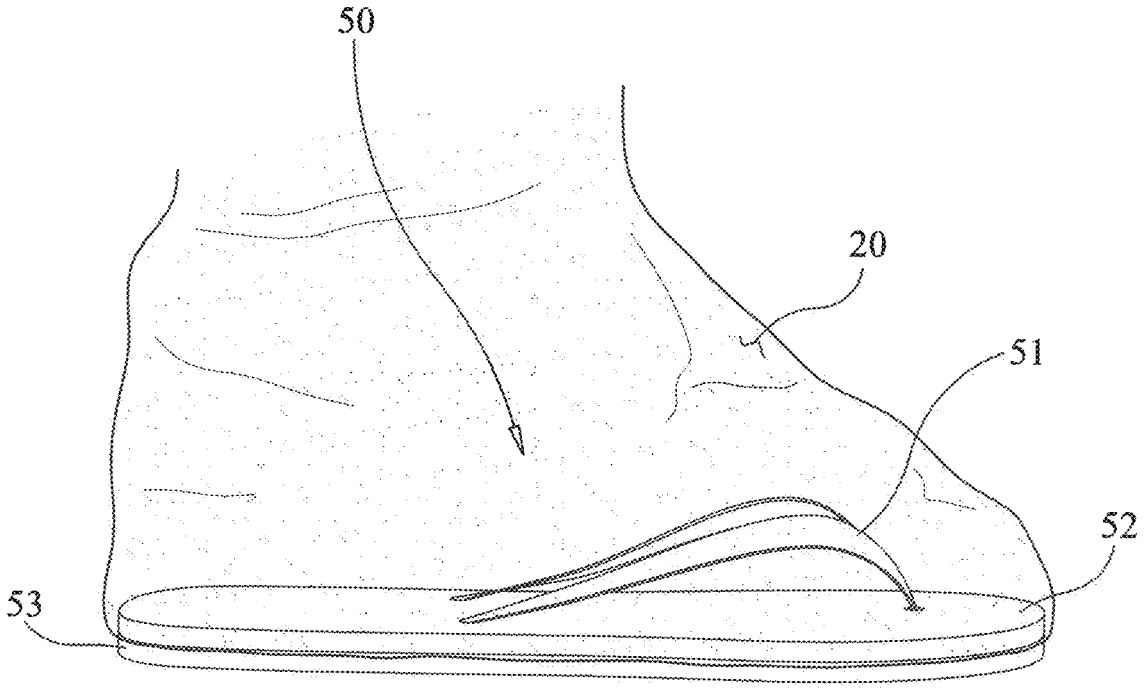
FIG. 3 is a partial side view of the exemplary embodiment of the protective garment depicted in FIG. 1.

1—Protective Garment
10—Pair of Pants
10A—First Pant Leg
10B—Second Pant Leg
15—Waistband
20—Perforated Fabric
21—Fiber
25—Mesh
26—Perforation
50—Footwear
51—Foot strap
52—Insole
52A—Top Surface of Insole
52B—Bottom Surface of Insole
53—Outsole
53A—Top Surface of Outsole
53B—Bottom Surface of Outsole
61—Snap Fasteners
61A—Male Component
61B—Female Component
62—Hook and Loop Fasteners
62A—Hook Fastener
62B—Loop Fastener
155—Toe Guard
255—Foot Guard

DETAILED DESCRIPTION

An exemplary, nonlimiting embodiment of the present disclosure provides a protective garment 1 configured to prevent insects, such as mosquitos and gnats, from biting the skin of the limbs and corresponding extremities which the protective garment 1 surrounds. The exemplary, nonlimiting embodiment of the protective garment 1 is preferably constructed of materials that are water resistant and lightweight.

The exemplary, nonlimiting embodiment of the protective garment 1 includes a pair of pants 10 and a pair of footwear 50. The pair of pants 10 provide a first and second pant leg 10A, 10B as well as a waistband 15, which is preferably constructed of an elastic material capable of elastically elongating to accommodate a variety of waist sizes. Each pant leg 10A, 10B has a respective bottom end. Each of the bottom ends of the pant legs 10A, 10B is preferable an enclosed end. The waistband 15 may be alternatively constructed of an enclosed belt which may be configured to secure the protective garment 1 around the waste of the individual wearing the protective garment 1 by means of a cinching mechanism. The cinching mechanism may also further include fasteners such as buckles, hook-and-loop, snaps, or buttons to uphold the diameter of the opening at the top of the pants.

The pair of pants 10 is fabricated from a perforated fabric 20. The perforated fabric 20 further comprises of a single layer of a plurality of fibers 21 woven together. The plurality of fibers 21 may comprise synthetic or natural fibers which upon being woven together form a mesh 25 which provides a plurality of perforations 26 of a maximum predetermined size. The predetermined maximum size of each perforation is preferably not greater than 0.25 square millimeters. Such a small maximum perforation size is preferable to prevent insects of varying sizes from directly contacting the skin of the individual wearing the protective garment 1. Additionally, the size of the plurality of perforations 21 allows for the perforated fabric 20 to be sufficiently permeable such that water and vapor may flow substantially unrestricted through the plurality of perforations 26. The perforated fabric 20 is also preferably lightweight fabric to provide comfort in warm weather and easy mobility.

Each footwear of the pair of footwear 50 is secured to the bottom of the distinct pant leg 10A, 10B, either permanently secured or detachable secured. It is anticipated that the pair of footwear 50 may comprise a pair of sandals, slippers, or closed toe shoes. Each footwear of the pair of footwear 50 comprises a plurality of elements that include an insole 52 and an outsole 53. The plurality of elements may further include a strap 51 that is attached to the insole 52, as exemplified in the exploded view of FIGS. 4-7. The insole 52 and outsole 53 each have a top surface 52A, 53A and a bottom surface 52B, 53B, respectively. It is preferable that the insole 52 and outsole 53 each be formed of a material which is compressible or semi-compressible. The insole 52 and outsole 53 are configured to be substantially aligned vertically and are connected to one another. It is further preferred that the bottom surface of the outsole 53B be formed of a durable material which is suitable for walking on exterior surfaces.

Figure 8:
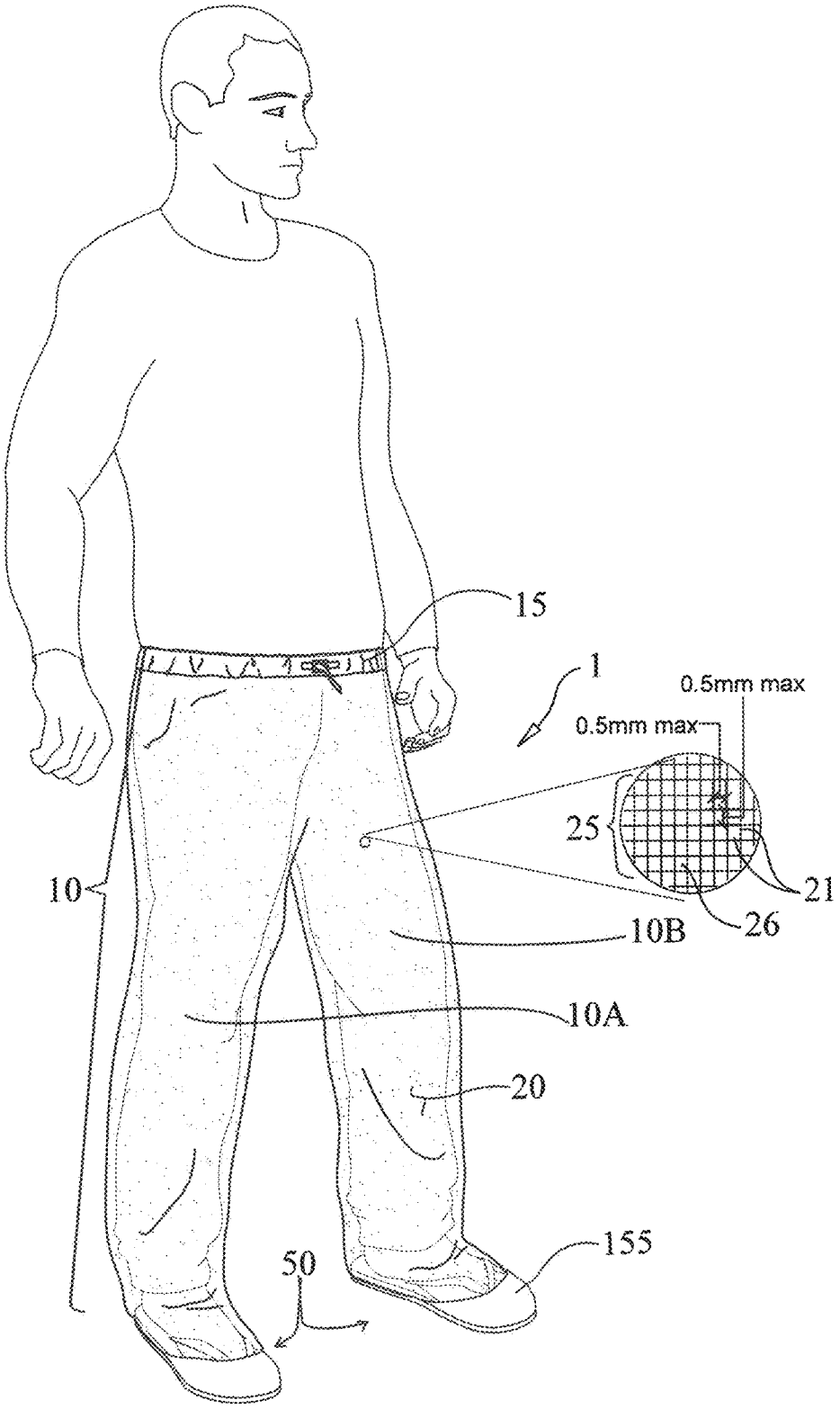
FIG. 8 is an in-use perspective view of an exemplary embodiment of the protective garment wherein the exemplary footwear provides an exemplary toe guard.
Figure 9:
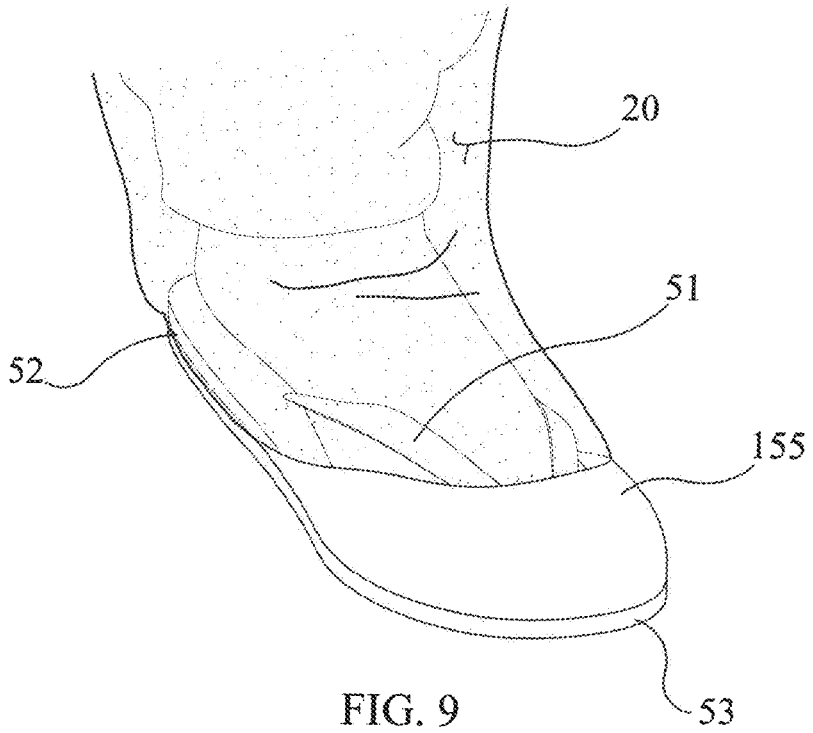
FIG. 9 is an enlarged view taken from FIG. 8 depicting a bottom portion of one of the two pant legs.
Figure 10:
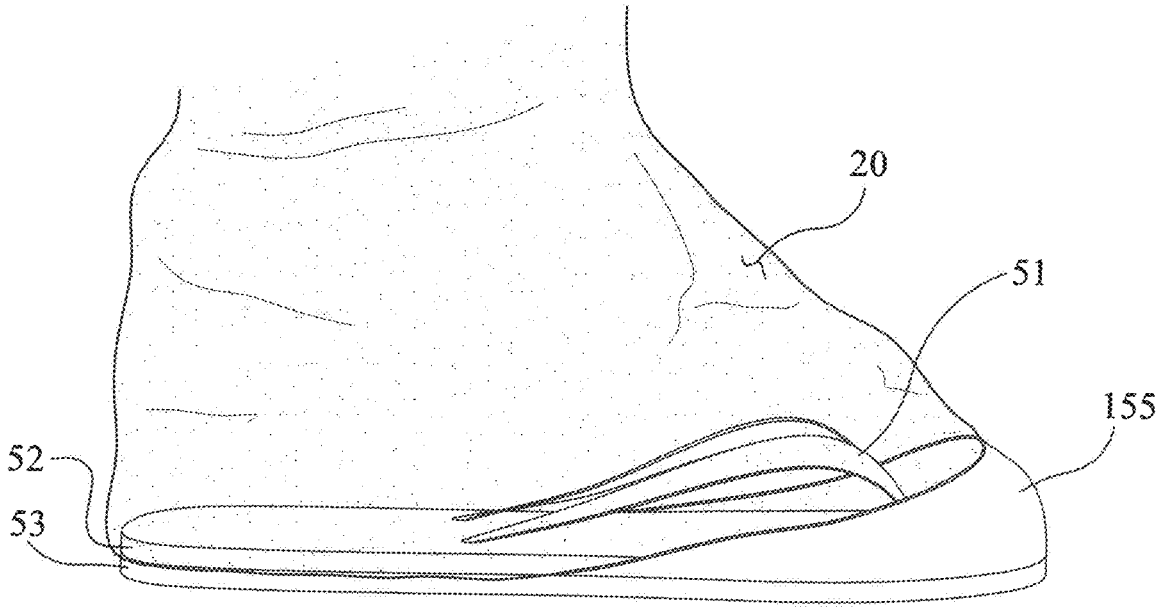
FIG. 10 is a partial side view of the exemplary embodiment of the protective garment depicted in FIG. 8.
Figure 11:
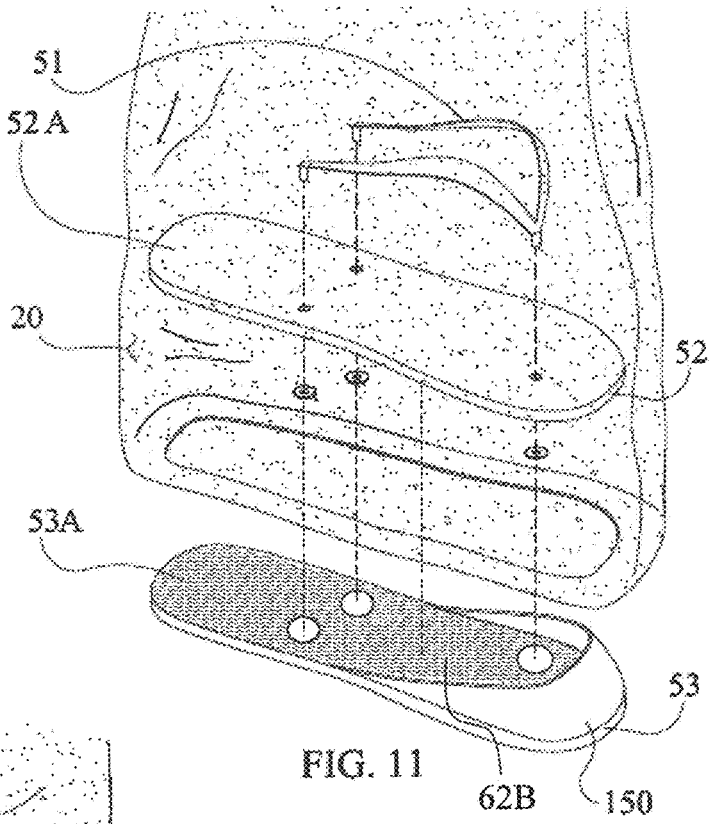
FIG. 11 is a partial exploded perspective view of the exemplary embodiment of the protective garment depicting a partial cross-section of the perforated fabric forming a pant leg to provide additional clarity of the exemplary footwear that is operatively connected to the perforated fabric wherein the perforated fabric is discontinuous at the bottom of the pant leg and the toe guard is integrally connected with the outsole of the exemplary footwear.
Figure 12:
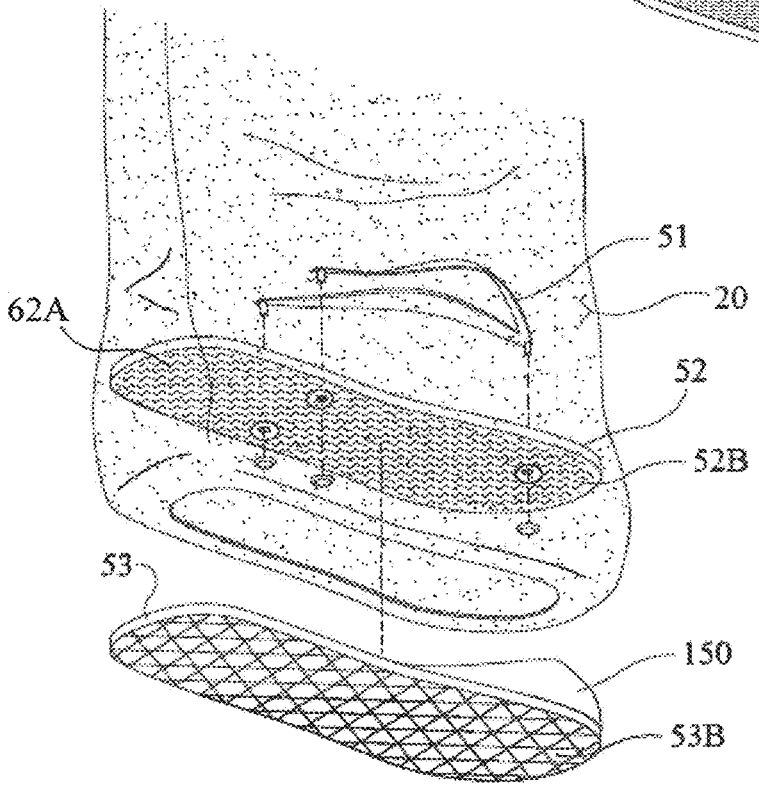
FIG. 12 is an alternative view of the partial exploded perspective view of the exemplary embodiment of the protective garment depicted in FIG. 11.
Figure 13:
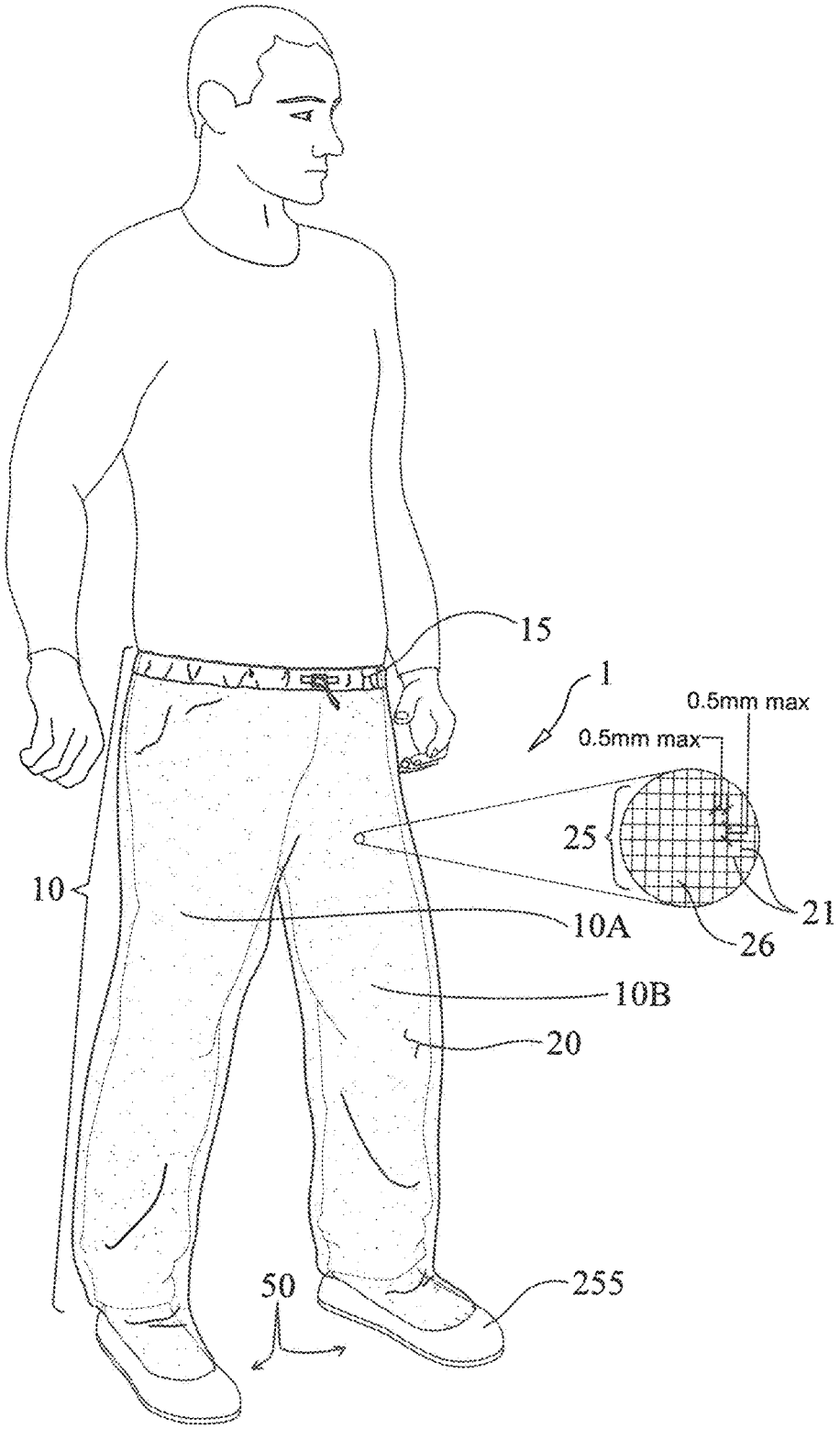
FIG. 13 is an in-use perspective view of an exemplary embodiment of the protective garment wherein the exemplary footwear provides a foot guard.
Figure 14:
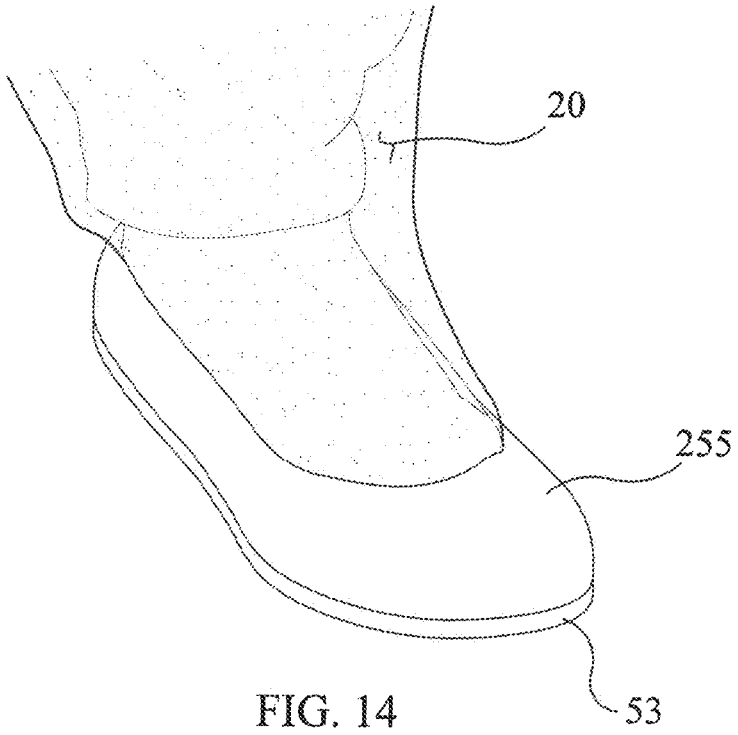
FIG. 14 is an enlarged view taken from FIG. 13 depicting a bottom portion of one of the two pant legs.
Figure 15:
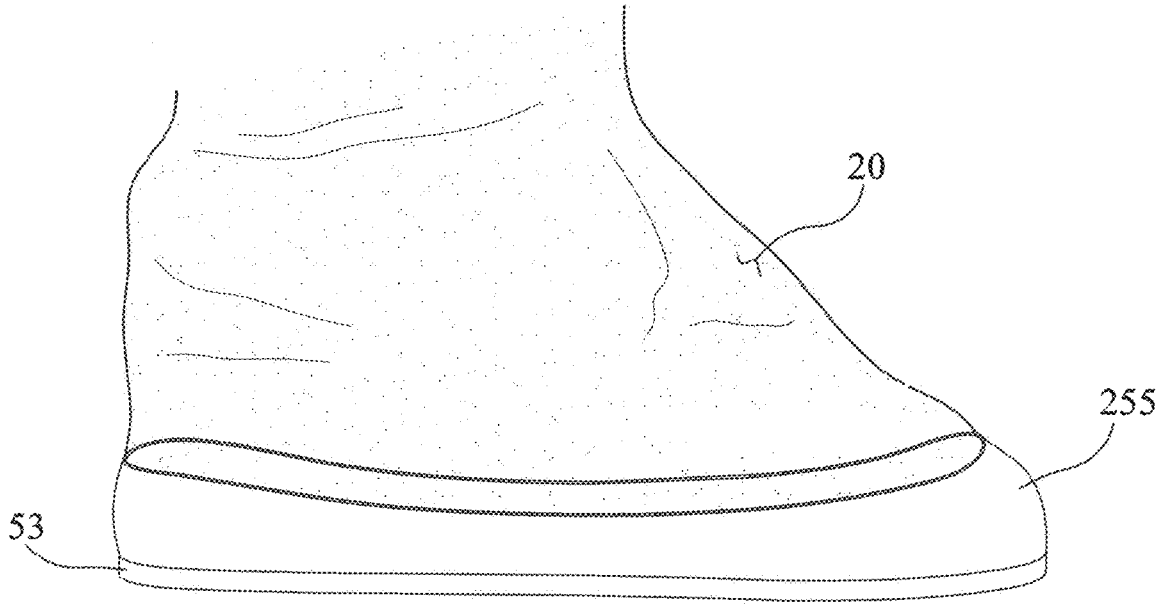
FIG. 15 is a partial side view of the exemplary embodiment of the protective garment depicted in FIG. 13.

It is anticipated that each outsole 53 may optionally further include a toe guard 155 or foot guard 255, as shown in FIGS. 8 and 13, respectively. Each toe or foot guard 155, 255 may either be integrally formed with or detachably connected to their respective outsole 53. Preferably the toe guards 155 convexly taper to form a partially enclosed cavity near the front of the footwear 50. The toe and foot guards 155, 255 each have a respective exterior and interior surface as well as a substantially uniform thickness. The foot guard 255 is configured to extend and convexly taper upwards along a perimeter of the insole 52, as shown in FIGS. 13-15. The toe or foot guards 155, 255 not only function to protect the feet of the individual wearing the protective garment 1, but also to protect the perforated fabric near the bottom of each pant leg 10A, 10B by configuring the perforated fabric 20 near the bottom of each pant leg 10A, 10B to span along the interior surface of the toe or foot guard 155, 255, as shown in FIGS. 9, 10, 14, and 15. It is anticipated that the straps 51 may be omitted from the pair of footwear 50 if the toe or foot guards 155, 255 are attached to the outsole 53.

The perforated fabric 20 substantially near the bottom end of each pant leg 10A, 10B is configured to extend underneath the insole 52 such that is secured between the bottom surface of the insole 52B and top surface of the outsole 53A. In one embodiment, the perforated fabric 20 is secured between the bottom surface of the insole 52B and top surface of the outsole 53A by means of a detachable securement mechanism. The detachable securement mechanism may include a variety of types of fasteners which provide a means for detachably securing the perforated fabric 20 substantially near the bottom of each pant leg 10A, 10B between the two surfaces 52B, 53A. The detachable securement mechanism allows the insole 52 and outsole 53 to be detached from one another which thereby disengages the perforated fabric 20. Optional disengagement of the perforated fabric 20 from the two surfaces 52B, 53A may be beneficial in a variety of situations, such as when an individual desires to wash the pair of pants 10 without risking damage to fabric 20 or replacement of a new pair of pants.

Figure 4:
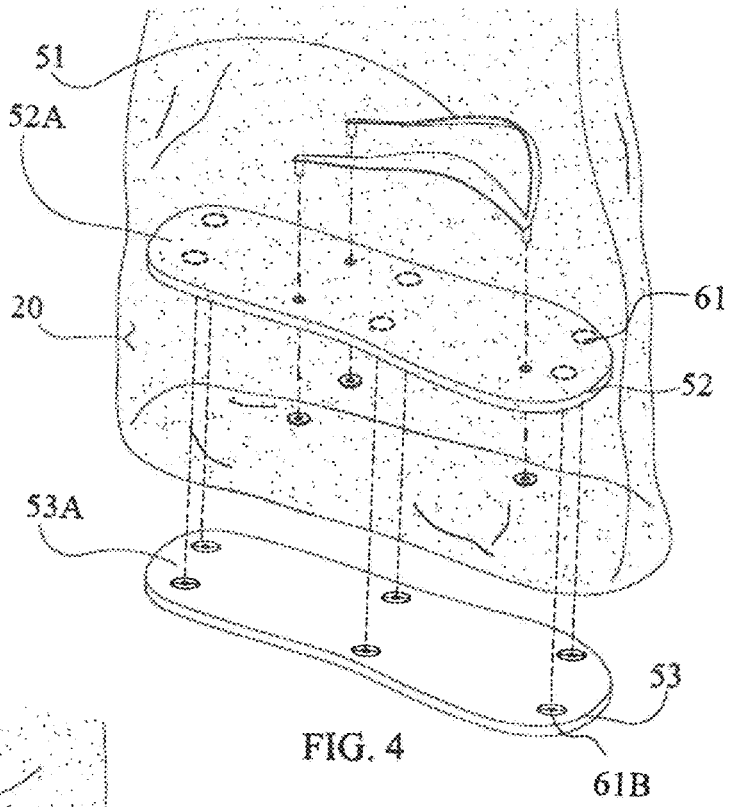
FIG. 4 is a partial exploded perspective view of the exemplary embodiment of the protective garment depicting a partial cross-section of the perforated fabric forming a pant leg to provide additional clarity of an exemplary footwear that is operatively connected to the fabric by a plurality of snap fasteners.
Figure 5:
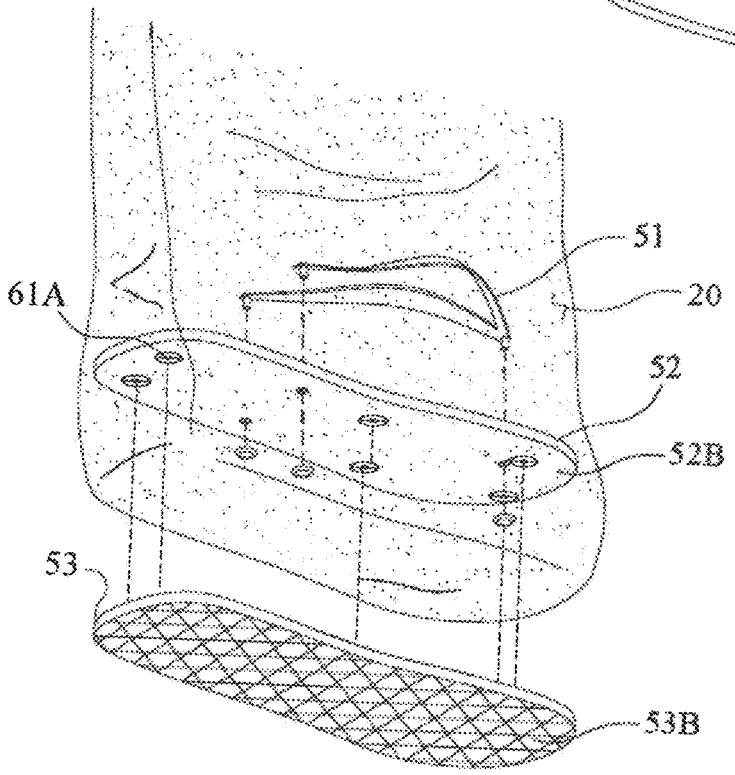
FIG. 5 is an alternative view of the partial exploded perspective view of the exemplary embodiment of the protective garment depicted in FIG. 4.
Figure 6:
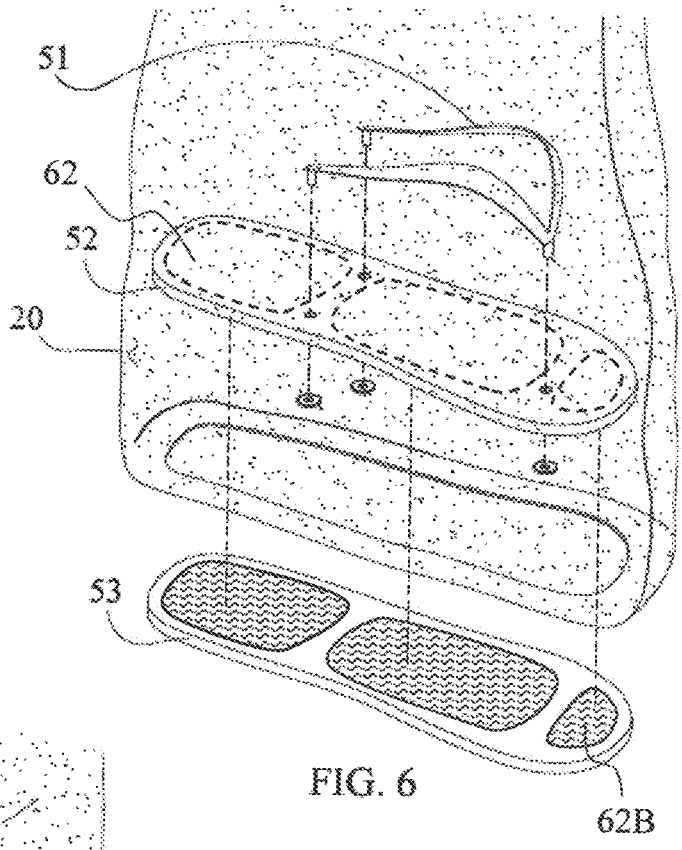
FIG. 6 is a partial exploded perspective view of the exemplary embodiment of the protective garment depicting a partial cross-section of the perforated fabric forming a pant leg to provide additional clarity of an exemplary footwear that is operatively connected to the perforated fabric wherein the perforated fabric is discontinuous at the bottom of the pant leg and the exemplary footwear is operatively connected to the fabric by hoop and loop fasteners.
Figure 7:
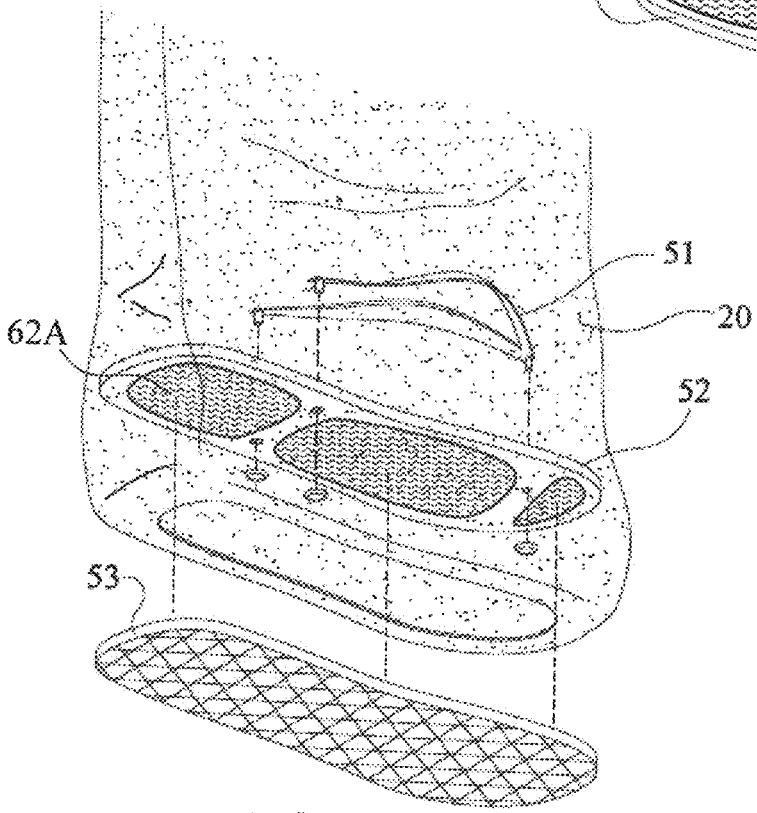
FIG. 7 is an alternative view of the partial exploded perspective view of the exemplary embodiment of the protective garment depicted in FIG. 6.

The mechanical securement mechanism may comprise a plurality of snap fasteners 61, as shown in FIGS. 4 and 5, provided by the insole 52 and outsole 53. The plurality of snap fasteners 61 includes a pair of male and female components 61A, 61B which when properly aligned and subjected to a minimum predetermined clamping force will mechanically interlock with one another. It is preferable that the female components 61B of the plurality of snap fasteners 61 be attached to the top surface of the outsole 53A and be oriented such each female component 61B may interlock with a corresponding male component 61A when each are vertically aligned with respect to one another and subjected to the predetermined clamping force. Correspondingly, it is also preferable for the male components 61A of the plurality of snap fasteners 61 to be attached to the bottom surface of the insole 52B and oriented such each male component 61A may interlock with a corresponding female component 61B when each are vertically aligned with respect to one another and subjected to the predetermined clamping force. However, it is anticipated that the male and female components 61A, 61B could be inverted, wherein the female components 61B are attached to the bottom surface of the insole 52B and the male components 61A are attached to the top surface of the outsole 53A, to perform a substantially equivalent function. Accordingly, it is necessary that each pair of male and female components be attached to their respective surfaces 52B, 53A such that they are substantially aligned with one another when the insole 52 and outsole 53 are vertically aligned.

Alternatively, the mechanical securement mechanism may comprise at least one pair of hook and loop fasteners 62, as shown in FIGS. 6 to 7, and 11 to 12. The at least one pair of hook and loop fasteners 62 include at least one hook fastener 62A and at least one of loop fastener 62B. The at least one hook fastener 62A may be configured to be adhered to either the top surface of the outsole 53A or bottom surface of the insole 52B. The at least one fastener 62B is correspondingly configured to be attached to the opposite surface 52B, 53A relative to the surface which the at least one hook fastener 62A at attached. The at least one pair of hook and loop fasteners 62A, 62B are attached to their respective surfaces 52B, 53A such that when the two surfaces 52B, 53A are substantially vertically aligned and firmly pressed against one another the at least one hook fastener 62A penetrates through the fabric 20 and interlocks with the at least one loop fasteners 62B.

It is further anticipated that the securement mechanism may comprise a plurality of mechanical fasteners, such as a plurality of dowels or tensioning cords, which substantially extend through the insole 52, perforated fabric 20 and outsole 53.

Alternatively, the securement mechanism may comprise adhesive, such that the perforated fabric 20 substantially near the bottom of each pant leg 10A, 10B may be adhered to the bottom surface of the insole 52 or top surface of the outsole 53 to further prevent dislodgement of the perforated fabric 20. It is further anticipated that the perforated fabric 20 near the bottom end of each pant leg 10A, 10B may be optionally stitched, or otherwise attached to itself, to enclose the respective pant leg 10A, 10B.

While one or more embodiments of the invention have been disclosed, certain modifications may be made by those skilled in the art to modify the invention without departing from the spirit of the invention.

The invention claimed is:

1. A protective garment for preventing insect bites, the protective garment comprises:
- a pair of pants;
  - wherein the pair of pants comprise a waistband, a first pant leg and a second pant leg;
  - wherein the first and the second pant legs each has a bottom end;
  - wherein the pair of pants is constructed of a perforated fabric;
  - wherein the perforated fabric comprises a single layer of a plurality of fibers;
  - wherein the plurality of fibers are woven together to form a mesh;
  - wherein the mesh comprises a plurality of perforations;
- a pair of footwear;
  - wherein the pair of footwear comprises an insole and an outsole;
  - wherein the insole is vertically aligned with the outsole;
  - wherein the insole and outsole each respectively provides a top surface and bottom surface;
  - wherein the bottom surface of the insole and the top surface of the outsole are operatively connected to one another by a securement mechanism;
  - wherein the perforated fabric near the bottom end of each pant leg is secured between the bottom surface of the insole and the top surface of the outsole by the securement mechanism;
  - wherein the outsole provides a toe guard;
  - wherein the toe guard is attached to the outsole; and
  - wherein the toe guard forms a tapered convex profile with a partially enclosed cavity near a front of the footwear.

2. The protective garment of claim 1, wherein each of the plurality of perforations provides an opening not greater in size than 0.25 square millimeters.

3. The protective garment of claim 1, wherein the securement mechanism comprises adhesive.

4. The protective garment of claim 1, wherein the securement mechanism comprises at least one snap fastener.

5. The protective garment of claim 4, wherein the at least one snap fastener further comprises at least one male component and at least one female component; and wherein the at least one male component correspondingly interlocks with the at least one female component.

6. The protective garment of claim 1, wherein the securement mechanism comprises at least one hook fastener and at least one loop fastener.

7. The protective garment of claim 6, wherein the at least one hook fastener penetrates through the perforated fabric and interlocks with the at least one loop fastener.

8. A protective garment for preventing insect bites, the protective garment comprises:
- a pair of pants;
  - wherein the pair of pants comprise a waistband, a first pant leg and a second pant leg;
  - wherein the first and the second pant legs each has a bottom end;
  - wherein the pair of pants is constructed of a perforated fabric;
  - wherein the perforated fabric comprises a single layer of a plurality of fibers;
  - wherein the plurality of fibers are woven together to form a mesh;
  - wherein the mesh comprises a plurality of perforations;
- a pair of footwear;
  - wherein the pair of footwear comprises an insole and an outsole;

wherein the insole is vertically aligned with the outsole;
wherein the insole and outsole each respectively provides a top surface and bottom surface;
wherein the bottom surface of the insole and the top surface of the outsole are operatively connected to one another by a securement mechanism;
wherein the perforated fabric near the bottom end of each pant leg is secured between the bottom surface of the insole and the top surface of the outsole by the securement mechanism;
wherein the outsole provides a foot guard; and
wherein the foot guard is attached to the outsole and vertically extends upwards along a perimeter of the insole.

9. The protective garment of claim 8, wherein each of the plurality of perforations provides an opening not greater in size than 0.25 square millimeters.

10. The protective garment of claim 8, wherein the securement mechanism comprises adhesive.

11. The protective garment of claim 8, wherein the securement mechanism comprises at least one snap fasteners.

12. The protective garment of claim 11, wherein the at least one snap fastener further comprises at least one male component and at least one female component; and wherein the at least one male component correspondingly interlocks with the at least one female component.

13. The protective garment of claim 8, wherein the securement mechanism comprises at least one hook fastener and at least one loop fastener.

14. The protective garment of claim 13, wherein the at least one hook fastener penetrates through the perforated fabric and interlocks with the at least one loop fastener.

15. A protective garment for preventing insect bites, the protective garment comprises:

a pair of pants;
wherein the pair of pants comprise a waistband, a first pant leg and a second pant leg;
wherein the first and the second pant legs each has a bottom end;
wherein the pair of pants are constructed of a perforated fabric;
wherein the perforated fabric comprises a single layer of a plurality of fibers;
wherein the plurality of fibers are woven together to form a mesh;
wherein the mesh comprises a plurality of perforations;
wherein each perforation of the plurality of perforations provides an opening not greater in size than 0.25 square millimeters, a pair of footwear;
wherein the pair of footwear comprises an insole and an outsole;
wherein the insole is vertically aligned with the outsole;
wherein the insole and outsole each respectively provide an top surface and bottom surface;
wherein the bottom surface of the insole and the top surface of the outsole are operatively connected to one another by a securement mechanism;
wherein the perforated fabric near the bottom end of each pant leg is secured to the bottom surface of the insole and top surface of the outsole by the securement mechanism.

16. The protective garment of claim 15, wherein each of the plurality of perforations provides an opening not greater in size than 0.25 square millimeters.

17. The protective garment of claim 15, wherein the securement mechanism comprises adhesive.

18. The protective garment of claim 15, wherein the securement mechanism comprises at least one snap fastener, and wherein the at least one snap fastener further comprises at least one male component and at least one female component; and wherein the at least one male component correspondingly interlocks with the at least one female component.

19. The protective garment of claim 15, wherein the securement mechanism comprises at least one hook fastener and at least one loop fastener.

20. The protective garment of claim 19, wherein the at least one hook fastener penetrates through the perforated fabric and interlocks with the at least one loop fastener.

* * * * *